US006272309B1

(12) United States Patent
Kitazawa et al.

(10) Patent No.: US 6,272,309 B1
(45) Date of Patent: Aug. 7, 2001

(54) FIXING APPARATUS

(75) Inventors: Kesaaki Kitazawa; Yuichiro Higashi; Yasuhide Hamada, all of Tokyo (JP)

(73) Assignee: Nitto Kogyo Co., Ltd., Tokyo (JP)

( * ) Notice: Subject to any disclaimer, the term of this patent is extended or adjusted under 35 U.S.C. 154(b) by 0 days.

(21) Appl. No.: 09/570,441

(22) Filed: May 12, 2000

(30) Foreign Application Priority Data

Nov. 8, 1999 (JP) ..... 11-316187

(51) Int. Cl.[7] ..... G03G 15/20

(52) U.S. Cl. ..... 399/333; 399/328; 399/329; 430/124

(58) Field of Search ..... 399/67, 328, 329, 399/330, 331, 333; 430/97, 99, 124

(56) References Cited

U.S. PATENT DOCUMENTS 4,763,158 * 8/1988 Schlueter Jr. ..... 399/330 X
5,249,949 * 10/1993 Aslam et al. ..... 399/328 X
5,530,536 * 6/1996 Henry et al. ..... 399/333
5,873,020 * 2/1999 Matsuura et al. ..... 399/329
5,999,764 * 12/1999 Okabayashi et al. ..... 399/67

* cited by examiner

*Primary Examiner*—Sandra Brase
(74) *Attorney, Agent, or Firm*—Armstrong, Westerman, Hattori, McLeland & Naughton, LLP

(57) ABSTRACT

The present invention provides a fixing apparatus which can secure a sufficient fixing performance even if a nip pressure is arranged in relatively low value. A fixing apparatus comprises a fixing member (12, 36) having an elastic layer (12B, 36B) formed on the fixing member at a side to which a sheet surface supporting an unfixed toner is contacted; a pressing member (18, 38) for making the sheet surface supporting the unfixed toner contact to the fixing member (12, 36) with a particular pressure and forming a nip portion between the fixing member and the pressing member; and a heating means (20) heating the fixing member(12, 36), wherein $0.05 \leqq P \cdot t/E \leqq 0.50$ is satisfied, where t (mm) is thickness of the elastic layer (12B, 36B), E (Pa) is Young's modulus of the elastic layer (12B, 36B) and P (Pa) is pressure in the nip portion.

19 Claims, 6 Drawing Sheets

FIXING APPARATUS

BACKGROUND OF THE INVENTION

1. Field of the invention

The present invention generally relates to a fixing apparatus for use in an electrophotographic equipment, such as copier, printer, facsimile and the like, to fuse and press an unfixed toner or an unfixed toner image formed on a recording sheet, such as paper and the like, and to fix the toner to the sheet permanently.

2. Prior Art

For a fixing apparatus of electrophotographic equipment, a roller system, so called two rollers system, has been applied, which comprises a fixing roller containing a heating source and a pressing roller pressed against the fixing roller with a particular pressure. In such a roller system, various related patent applications have been filed and this system has been widely used. In recent years, a new fixing system, so called a belt fixing system, has been proposed and has also been offered for practical use as more advanced fixing system than the two rollers system. Specifically, this system comprises a fixing roller containing no heating source, a heating roller containing a heating source, a fixing belt as sort of endless type which is extended from the fixing roller to the heating roller with tension, and a pressing roller adapted to press the fixing roller through the fixing belt.

Whenever any conventional systems having such constructions are used, it is essential to supply a suitable amount of heat to an unfixed toner or toner image supported on a sheet for fusing it, that is, the unfixed toner should be adequately heated and fused. In addition, a particular pressure must also be applied to the unfixed toner, which has been fused, for fixing it on the sheet, that is, the unfixed toner fused should adequately be pressed.

Thus, in any conventional systems, the fixing roller and the pressing are pressed each other with a particular pressure to form a nip portion therebetween and a sheet supporting an unfixed toner is heated and pressed by the nip when the sheet is passed through the nip portion.

However, in any fixing apparatuses of the conventional systems, when the applied pressure at the nip portion (hereinafter, refer to nip pressure) was insufficient, there causes a problem such that a toner image would not be fixed on a sheet, e.g. the toner image would be fallen off from the sheet by touching the image with hand, due to the offset effect under low pressure. Thus the nip pressure is arranged with relatively high value for ensuring to eliminate the offset effect under low pressure. Specifically, the nip pressure is approximately 200 kPa even in a low speed type fixing apparatus, and the pressure should be increased up to approximately 250 k Pa in an intermediate or high-speed type fixing apparatus.

Since the nip pressure is arranged in the relatively high pressure, the pressure acts to a driving unit for transferring a sheet as driving resistance so that the driving unit must be enforced to drive with higher torque. Consequently, a high torque type driving motor, which is expense, must be equipped as a driving source for the driving unit and the transmission mechanism of the driving unit also requires higher quality on durability for the higher transmitted torque in the driving unit. This results in cost overrun.

Further, since the driving unit is driven with high torque, it may be hard to maintain effective lifetime of each components of the driving unit. Thus, it is desired to improve the effective lifetime.

Furthermore, in such conventional fixing apparatus using rollers, since the major diameter and/or the radial thickness of the roller requires to be larger in order to prevent bending of the roller, the size and weight of the apparatus are increased. It is also desired to improve this problem.

SUMMARY OF THE INVENTION

The present invention is developed to solve the aforementioned problems. One primary object of the present invention is to provide a fixing apparatus which can secure a sufficient fixing performance even if a nip pressure is arranged in relatively low value.

Another object of the present invention is to provide a fixing apparatus which can achieve to reduce its cost by lowering a nip pressure to enable to use a low torque type driving source.

Further, still other object of the present invention is to provide a fixing apparatus which can achieve to reduce the size and weight of a driving source and components used in the apparatus by lowering a nip pressure.

Furthermore, yet other object of the present invention is to provide a fixing apparatus which can achieve to extend an effective lifetime of the entire apparatus by lowering a nip pressure to enable to reduce torque in a driving unit of the apparatus.

For solving the aforementioned problem and also achieving the described object, a fixing apparatus according to the present invention comprises: a fixing member having an elastic layer formed on the fixing member at a side to which a sheet surface supporting an unfixed toner is contacted; a pressing member for making the sheet surface supporting the unfixed toner contact to the fixing member with a particular pressure and forming a nip portion between the fixing member and the pressing member; and a heating means heating the fixing member, wherein $0.05 \leqq P \cdot t/E \leqq 0.50$ is satisfied, where t (mm) is thickness of the elastic layer, E (Pa) is Young's modulus of the elastic layer and P (Pa) is pressure of the nip portion, as the first feature.

In addition to the first feature, in a preferable embodiment according to the present invention, the Young's modulus E (Pa) of the elastic layer and the pressure P (Pa) of the nip portion may satisfy $P/E \leqq 0.50$.

In addition to the first feature, in another preferable embodiment according to the present invention, the fixing member may include a fixing roller having the elastic layer on a periphery of the fixing roller, to which the sheet surface supporting the unfixed toner is contacted, and the pressing means includes an endless-like pressing belt contacted to the elastic layer of the fixing roller with a particular nip width. The heating means may include a first heat-generating source for heating the fixing roller. The pressing belt may be wound around plural supporting rollers spaced apart each other in endless manner with positioning the fixing roller between each of the plural supporting rollers and the heating means may further include a second heat-generating source for heating the pressing belt.

In addition to the first feature, in another preferable embodiment according to the present invention, the fixing member may include an endless-like fixing belt having the elastic layer on a periphery of the fixing roller, to which the sheet surface supporting the unfixed toner is contacted, and the pressing means may include an pressing roller contacted to the elastic layer of the fixing belt with a particular nip width. The fixing belt may be wound around plural supporting rollers spaced apart each other in endless manner with positioning the pressing roller between each of the plural supporting rollers and the heating means may include a first heat-generating source for heating the fixing belt. The heating means may further include a second heat-generating source for heating the pressing roller.

In addition to the first feature, in another preferable embodiment according to the present invention, the fixing member may include a releasing layer on a periphery of the elastic layer.

In addition to the first feature, in another preferable embodiment according to the present invention, thickness t of the elastic layer may be arranged in the range from 0.15 (mm) to 2.0 (mm).

In addition to the first feature, in another preferable embodiment according to the present invention, the Young's modulus E may be arranged in the range from 150 (k Pa) to 2400 (k Pa).

In addition to the first feature, in another preferable embodiment according to the present invention, the nip pressure P may be arranged in the range from 25 (k Pa) to 200 (k Pa).

These and other aspect of the present invention are apparent in the following detailed description and claims, particularly when considered in conjunction with the accompanying drawings.

DETAILED DESCRIPTION OF THE PREFERRED EMBODIMENTS

Figure 1:
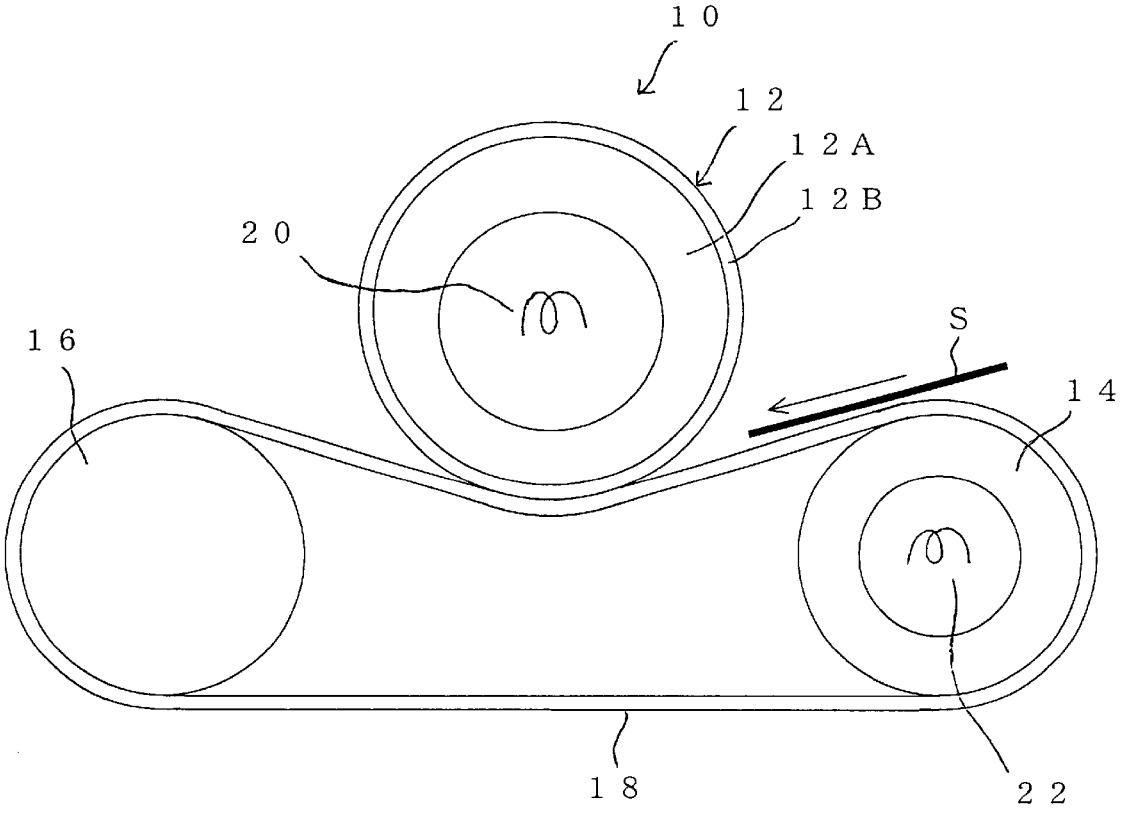
FIG. 1 is a schematic front view showing an arrangement of one embodiment of a fixing apparatus according to the present invention.
Figure 2:
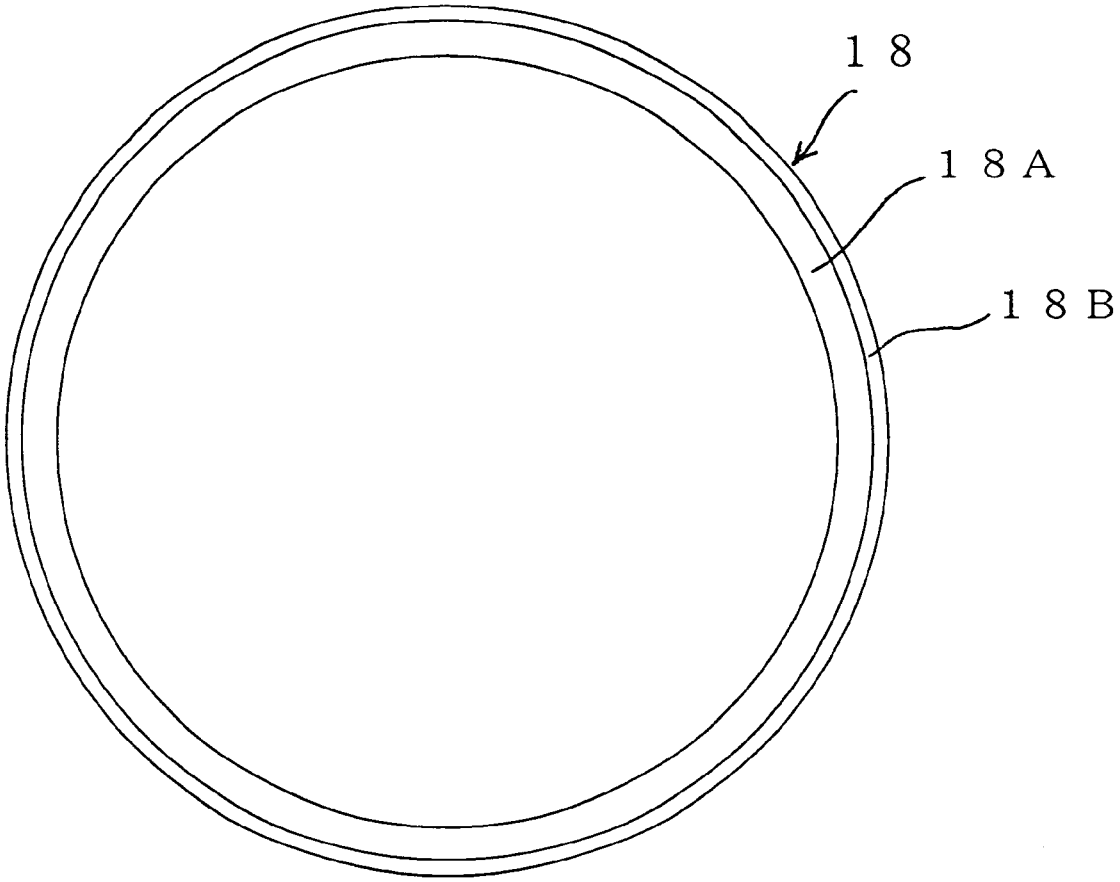
FIG. 2 is a schematic enlarged fragmentary front view showing a pressing belt equipped for the fixing apparatus shown in FIG. 1.

Referring now to FIG. 1 and FIG. 2 in the accompanying drawings, the first preferred embodiments of a fixing apparatus according to the present invention will be described in detail as follows.

As shown in FIG. 1, a fixing apparatus 10 of this embodiment basically includes a fixing housing (not shown) secured to an electrophotographic image producing equipment (not shown), e.g. a frame of an electronic printer. The fixing apparatus also basically includes a fixing roller 12 as a fixing member, a pair of supporting rollers 14 and 16 spaced apart each other with positioning this fixing roller therebetween, and an endless-like pressing belt 18 as a pressing member wound around both supporting rollers 14 and 16 in endless manner and forming a wide range of nip portion by means of being pressed against a peripheral surface of the fixing roller 12 with relatively low pressure, within the fixing housing.

A sheet S supporting an unfixed toner (hereinafter, refer to an unfixed sheet) is adapted to be transferred to a direction shown by an arrow in FIG. 1 with directing a sheet surface of the sheet, to which the unfixed toner is supported, upwardly. In relationship on the arrangement of the fixing roller 12 and both supporting rollers 14 and 16, the pressing belt 18 wound around both supporting rollers 14 and 16 is contacted at lower side of the fixing roller 12 upwardly with a particular nip width (in this embodiment, the nip width is 10 mm in the circular arc distance along the periphery of the fixing roller). The fixing roller 12 is located above with respect to the pressing belt 18.

Thus the unfixed sheet is guided through a guide member (not shown) to the nip portion formed of the fixing roller 12 and the pressing belt 18 at an angle from upward and is then passed through the nip portion.

A first halogen lamp 20 as a first heat-generating source is disposed within the aforementioned fixing roller 12 for heating the fixing roller 12. A second halogen lamp 22 as a second heat-generating source for heating the pressing belt 18 is also disposed within the supporting roller 14, which is one of the supporting rollers 14 and 16 and is located at upstream of the fixing roller 12 in the transferring direction of the unfixed sheet.

Herein the fixing roller 12 is adapted to be rotated clockwise by a driving mechanism (not shown) for certainly transferring the unfixed sheet, which is nipped in the nip portion, toward the left hand of FIG. 1. Thus the fixing roller 12 is rotatively driven, thereby when the unfixed sheet is not nipped in the nip portion, the pressing belt 18 is rotatively worked with the fixing roller according to the rotation of the fixing roller due to direct frictional engagement between the fixing roller 12 and the pressing belt 18. When the unfixed sheet is nipped in the nip portion, the pressing belt 18 is also rotatively worked with the fixing roller 12 due to indirect frictional engagement between the fixing roller 12 and the pressing belt 18 through the unfixed sheet. In this embodiment, a sheet transfer speed of the pressing belt is arranged in 100 mm/sec.

A nip pressure P corresponding to a pressing force of the pressing belt against the fixing roller can be optionally arranged in any value by adjusting tension of the pressing belt 18. In this embodiment, the nip pressure P is arranged at extremely low pressure of 50 (k Pa) as compared with the nip pressure approximately from 200 (k Pa) to 250 (k Pa) in the conventional two rollers system or belt system.

This nip pressure P can be arranged at any value within the rang from 25 (k Pa) to 200 (k Pa). A selecting condition for the upper limit and lower limit of this range will be described in detail hereinafter.

Next, each configuration of the fixing roller 12, the pair of supporting rollers 14, 16 and the pressing belt 18 will be described in detail.

The fixing roller 12 comprises a core bar 12A, which is pipe-like and made of aluminum, having major diameter of 23 (mm) and radial thickness of 1.0 (mm), and a silicon rubber layer 12B as a elastic layer coated over a periphery of this core bar 12A with thickness of 1.0 (mm). That is, major diameter of the fixing roller 12 as a final product is 25 (mm). The silicon rubber layer 12B used has rubber hardness degrees of 20 degrees (ASKER C) and Young's modulus of 300 (k Pa).

The thickness t of the silicon rubber layer 12B of this fixing roller 12 can be arranged at any value within the rang from 0.15 (k Pa) to 2.0 (k Pa). A selecting condition for the upper limit and lower limit of this range is described in detail hereinafter. Young's modulus E of the elastic layer can be arranged at any value within the rang from 150 (k Pa) to 2400 (k Pa). A selecting condition for the upper limit and lower limit of this range will also be described in detail hereinafter.

The supporting roller 14 in which the second heat-generating source 22 is contained comprises a core bar, which is pipe-like and made of STKM, having major diameter of 20 (mm) and radial thickness of 1.0 (mm), and a fluoroplastics layer applied over a periphery of this core bar with thickness of 20 (μm). The opposite supporting roller 16 also comprises a core bar, which is solid and made of SUM, having major diameter of 19.9 (mm), and a fluoroplastics layer applied over a periphery of this core bar with thickness of 50 (μm).

In a condition that the endless-like pressing belt 18 is in form of cylindrical shape as shown in FIG. 2, the endless-like pressing belt 18 is formed to have inside diameter of 50 (mm). The endless-like pressing belt 18 comprises a belt base 18A having thickness of 40 (μm), which is fabricated from nickel and electroformed, and a silicon rubber layer 18B uniformly applied over a periphery of this belt base 18A with thickness of 0.3 (mm). This elastic layer 18B used has rubber hardness degrees of 20 degrees (ASKER C) and Young's modulus of 300 (k Pa).

Using the fixing apparatus constructed as described above, an unfixed sheet was passed through the nip portion. As a result, trouble-free fixing operation was completed in terms of fixing degree and also image quality.

The fixing degree was evaluated as follows. That is, a fixed sheet, to which unfixed toner on the sheet has been fixed by the fixing apparatus as described above, was folded into two from its back surface and the fold line formed was sufficiently rubbed. The fixed sheet was then opened up again and the fold line portion was rubbed by a soft waste or the like. After these operations, the status whether the toner was fallen off at the fold line portion was visually observed. When the toner was fallen off only at a potion corresponding to the fold line, the status was evaluated as good. In contrast, when the toner was fallen off not only at a potion corresponding to the fold line but also on the periphery of the fold line, the status was evaluated as bad.

The image quality was evaluated from viewpoint of uniformity in black solid printing, distortional nip trace and gloss degree. When the every viewpoint was satisfied, the status was evaluated as good. In contrast, when at least one of the viewpoints was not satisfied, the status was evaluated as bad on the whole.

The inventors of the present invention turned their attention to the factor why sufficient fixing function could be certainly achieved even with low nip pressure and, as a result, it was found that the periphery of the fixing roller 12 needs certainly to be contacted to the unfixed toner and paper with wrapping around the unfixed toner throughout a range of the nip width. Finally, the inventors creatively found that the compressive deformation amount At of the elastic layer of the fixing roller 12 must be in a particular range.

Compressive deformation amount Δt is a value defined by the following formula:

$$\Delta t = P \cdot t / E \tag{1}$$

where P is the nip pressure (k Pa), t is thickness of the elastic layer (mm) and E is Young's modulus of the elastic layer (k Pa).

As described above, the fixing apparatus of this embodiment is arranged with the nip pressure P of 50 (k Pa), the thickness t of the elastic layer of the fixing roller 12 of 1.0 (mm) and the Young's modulus E of the elastic layer of the fixing roller 12 of 300 (k Pa). Therefore, when these values are applied to the aforementioned formula in order to calculate the compressive deformation amount Δt in this embodiment, Δt=0.167 (mm)=167 (μm) is given.

Next, verification of the allowance range of the aforementioned compressive deformation amount Δt will be described. Each allowance range of three factors defining compressive deformation amount Δt is as follows.

For the nip pressure P, the range from 25 (k Pa) to 200 (k Pa) was allowable. That is, it was found that when the nip pressure P was smaller than 25 (k Pa), undesirable skidding is caused between the fixing roller 12 and the pressing belt 18. Besides, when the pressure P at the nip portion is larger than 200 (k Pa), the compressive force of the pressing belt 18 is undesirably increased so that the snaking movement cannot be adequately controlled.

For the thickness t of the elastic layer, the range from 0.15 (mm) to 2.0 (mm) was allowable. That is, it was found that the thickness t of 0.15 (mm) is a threshold of the thickness considering the compressive deformation amount Δt of elastic material so that the thickness less than this threshold causes undesirable effect. It was also found that the thickness t lager than 2.0 (mm) is undesirable from the viewpoint of thermal responsiveness.

For the Young's modulus E of the elastic layer, the range from 150 (k Pa) to 2400 (k Pa) was allowable. That is, it was found that when the Young's modulus E is smaller than 150 (k Pa), crack in the layer might is undesirably resulted due to its weakened solid-state properties. It was also found that the Young's modulus E larger than 2400 (k Pa) is undesirable from the viewpoint of workability of the elastic layer.

Rubber compressive deformation amounts Δt were calculated for several values which were suitably selected from each of nip pressure P, thickness t of the elastic layer and Young's modulus E of the elastic layer within each allowance range. Then the fixing degree and image quality in each calculated rubber compressive deformation amount Δt were evaluated. Specifically, the selected values of nip pressure P were 6 points of 25 (k Pa), 50 (k Pa), 75 (k Pa), 100 (k Pa), 150 (k Pa) and 200 (k Pa). The selected values of the thickness t of the elastic layer were 8 points of 0.15 (mm), 0.3 (mm), 0.5 (mm), 0.6 (mm), 0.8 (mm), 1.0 (mm), 1.5 (mm) and 2.0 (mm). The selected values of the Young's modulus E of the elastic layer were 5 points of 150 Pa), 300 (k Pa), 600 (k Pa ) , 1200 (k Pa) and 2400 (k Pa). The calculation result and the evaluation result are shown in table 1 through table 3 in the form of showing relationship between the compressive deformation amount Δt and the fixing quality (fixing degree and image quality).

From these tables 1 through 3, it was found that when the rubber compressive deformation amount Δt (=P·t/E) is arranged to satisfy the relationship of the following formula (inequality), both fixing degree and image quality are satisfied.

$$0.05 \leqq \Delta t \leqq 0.50 \text{ unit (mm)} \tag{2}$$

In the evaluation column of each measured value shown in the tables, a mark "—" shows that the measurement was incomplete, a mark "X" shows that at least one of fixing degree and image quality was evaluated as bad and a mark "○" shows that both fixing degree and image quality were evaluated as good. Herein since the method for evaluating fixing degree and image quality is the same as the aforementioned evaluation method, the description is abbreviated.

When the rubber compressive deformation amount Δt is smaller than its lower limit of 0.05 (mm), the fixing degree and the image quality cannot be desirably assured because the elastic layer of the fixing roller 12 cannot be contacted to the toner which exists in depressions of paper fiber. Besides, the Δt is larger than its upper limit of 0.50 (mm), the performance for releasing a sheet is undesirably deteriorated because adhesiveness to a sheet is excessively increased.

In the aforementioned tables 1 through 3, in case that the nip pressure P is 75 (k Pa) and the Young's modulus E is 150 (k Pa), that the nip pressure P is 100 (k Pa) and the Young's modulus E is 150 (k Pa), that the nip pressure P is 150 (k Pa) and the Young's modulus E is 150 (k Pa) and 300 (k Pa), and that the nip pressure P is 200 (k Pa) and the Young's modulus E is 150 (k Pa) and 300 (k Pa), their evaluation results ought to be good because the aforementioned formula is satisfied. However, each case had a problem of the fixing degree or the image quality, therefore all cases were evaluated as bad. This is caused from a problem that, when the fixing apparatus is activated to fix black solid image after shutting off a power source of the fixing apparatus and leaving it for 48 hours, the nip trace is occurred on the image in the rang from the first fixed sheet almost to the fifth fixed sheet. Such nip trace tends to disappear by repeating the fixing operation.

It was found that such problem of the nip trace is occurred substantially when the P/E value is larger than 0.50. That is, it is found that the following inequality (3) should preferably be satisfied.

$$P/E \leqq 0.50 \quad (3)$$

In particular, it was also found that, when the P/E value becomes higher, the nip trace on image is more emphasized and number of papers passing through the nip portion (number of the fixing operations) before the nip trace disappears is also increased. Thus it is more preferable condition that the P/E value is equal to or less than 0.50.

In this embodiment, it is not necessary to provide the elastic layer 18B on the periphery of the pressing belt base 18A. However, when the fixing apparatus 10 of this embodiment was applied to equipment capable to fix images on both surfaces of the sheet S, i.e. equipment capable to print on both sides of a sheet or a perfecting machine, the elastic layer 18B must also be applied on the periphery of the pressing belt base 18A. The unfixed sheet S is described on condition that an unfixed toner image is supported only on the upper surface of the unfixed sheet, but when another unfixed toner image is also supported on lower surface of the unfixed sheet, it is necessary to form the elastic layer 18B on the periphery of the pressing belt base 18A.

As described above, according to this embodiment, sufficient fixing function can be certainly achieved even with low nip pressure by means of arranging the rubber compressive deformation amount Δt to satisfy the aforementioned inequality expressed by formula (1). As a result, torque necessary to a driving motor for a fixing apparatus can be reduced and components having reduced requirement to durability for high torque and pressure can also be used, thereby smaller size and lighter weight of the fixing apparatus can be achieved. In addition, when the nip pressure is arranged at relatively high-pressure condition, thickness of the elastic layer 18B can be arranged to be thinner in accordance with the aforementioned formula (1), thereby energy saving of the entire equipment can be achieved by shortening a warming-up time and effective lifetime of the roller and belt can be extended.

While the present invention has been described with respect to the first embodiment, it is to be understood that the present invention is not limited thereto and that it can be variously practiced within the aspect and scope of the present invention.

For example, while the first halogen lamp 20 contained within the fixing roller 12 is described as the first heat-generating source in the first embodiment, the present invention is not limited to such construction. Specifically, a sheath heater may be applied as the first heat-generating source. It follows that any means capable to heat the fixing roller 12 up to a particular temperature can be applied. Further, this first heat-generating source is not limited o be contained within the fixing roller 12, that is, it is apparent that the source may be disposed outside of the fixing roller 12.

In the first embodiment, while the second halogen lamp 22 contained within the supporting roller 14 is described as the second heat-generating source, the present invention is not limited to such construction. Specifically, a sheath heater may be applied as the second heat-generating source. It follows that any means capable to heat the pressing belt 18 up to a particular temperature can be applied.

Further, this second heat-generating source is not limited to be contained within the supporting roller 14, that is, it is apparent that the source may be disposed outside of the supporting roller 14 to directly heat the pressing belt 18.

In the first embodiment, while the construction including both the first heat-generating source and the second heat-generating source is described, the present invention is not limited to such construction.

Specifically, it is necessary to provide the first heat-generating source 20 for heating at least the fixing roller 12, but the second heat-generating source may be additionally provided if required, that is, when heat quantity from the first heat-generating source 20 is insufficient.

In the first embodiment, while it is described that the fixing member is comprised of the fixing roller 12 and the pressing member is comprised of the pressing belt 18, the present invention is not limited to such construction. Specifically, it may be constructed as another embodiment shown in FIG. 3 and FIG. 4. Thereinafter another embodiment of the present invention will be described with reference to FIG. 3 and FIG. 4, in which like parts bear like reference numerals and their description will be abbreviated.

Figure 3:
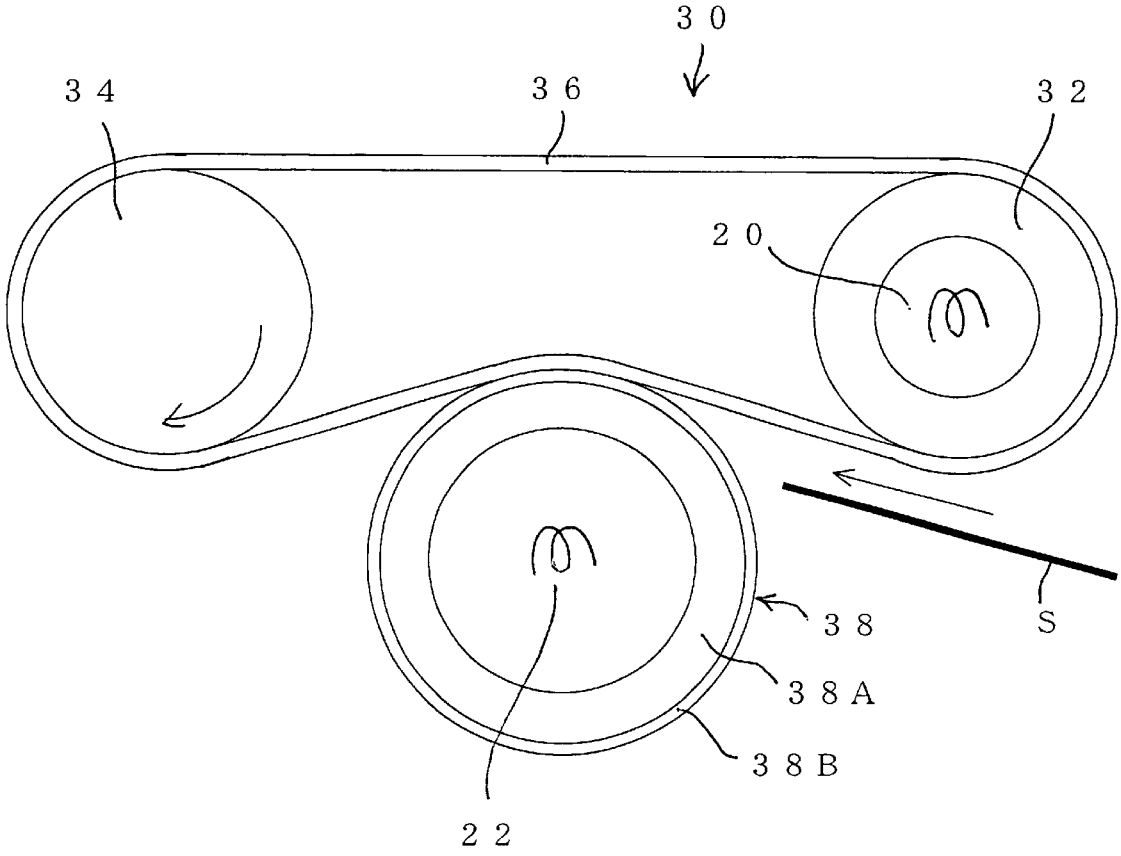
FIG. 3 is a schematic front view showing an arrangement of another embodiment of a fixing apparatus according to the present invention.
Figure 4:
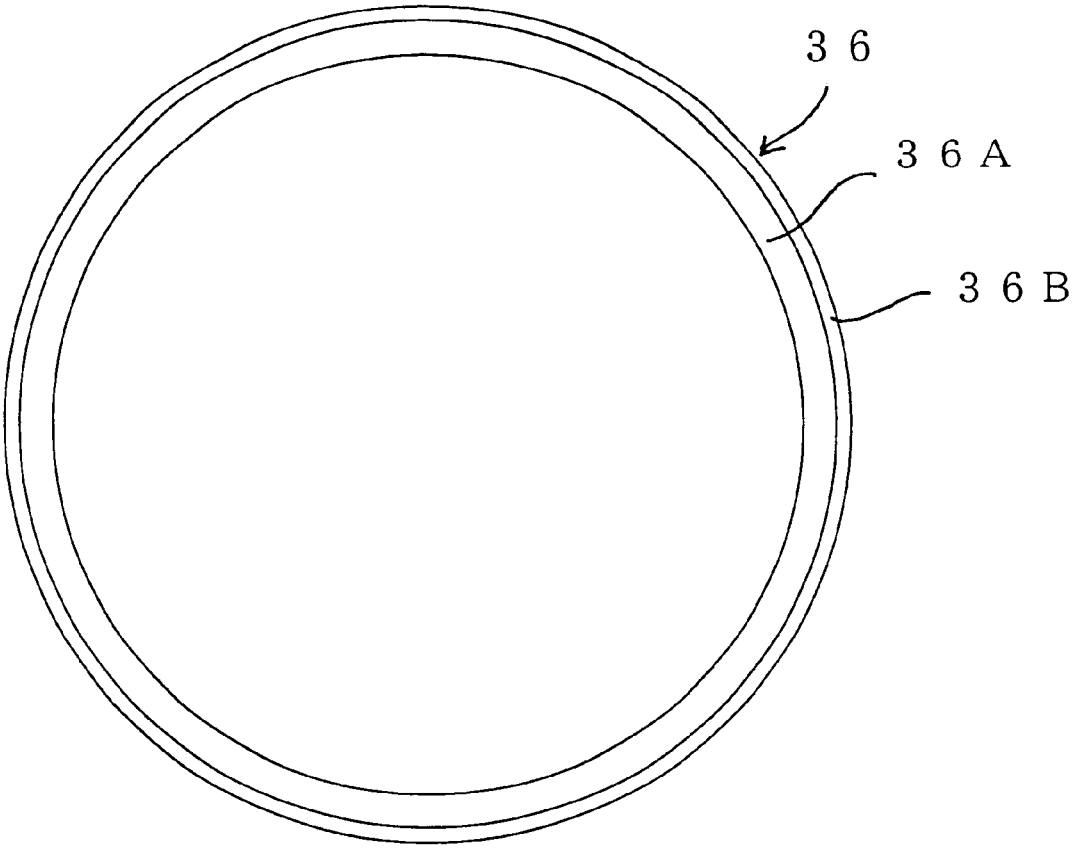
FIG. 4 is a schematic enlarged fragmentary front view showing a fixing belt equipped for the fixing apparatus shown in FIG. 3.

As shown in FIG. 3, a fixing apparatus 30 of another embodiment basically includes a fixing housing (not shown) as well as the first embodiment. The fixing apparatus also includes a pair of supporting rollers 32 and 34 spaced apart each other, a fixing belt as a fixing member wound around both supporting rollers 14 and 16 in endless manner, a pressing roller 38 as a pressing member which is disposed between the supporting rollers 14 and 16 and forms a wide range of nip portion by means of being pressed against a peripheral surface of the fixing belt 36 with relatively low pressure, within the fixing housing. The fixing belt 36 is disposed above with respect to the pressing roller 38.

An unfixed sheet S is adapted to be transferred to a direction shown by an arrow in FIG. 3 with directing a sheet surface of the sheet, to which the unfixed toner is supported, upwardly. In relationship on the arrangement of the fixing belt 36 and both supporting rollers 32 and 34, the pressing roller 38 is contacted to the fixing belt 36 wound around both supporting rollers 32 and 34 from under side of the fixing belt upwardly with a particular nip width (in this embodiment, the nip width is 10 mm in the circular arc distance along the periphery of the pressing roller). Thus the unfixed sheet S is guided through a guide member (not shown) to the nip portion formed of the fixing belt 36 and the pressing roller 38 at an angle from downward and is then passed through the nip portion.

A first halogen lamp 20 as a first heat-generating source for heating the fixing belt 36 is disposed within the supporting roller 32, which is one of the aforementioned supporting rollers 32 and 34 and is located at upstream of the pressing roller 38 in the transferring direction of the unfixed sheet. A second halogen lamp 22 as a second heat-generating source for heating the pressing roller 38 is also disposed within the pressing roller 38.

Herein the supporting roller 34 positioned in left side of FIG. 3 is adapted to be rotated clockwise by a driving mechanism (not shown) for certainly transferring the unfixed sheet nipped in the nip portion toward the left hand of FIG. 3. Thus the fixing belt 36 is movably driven, thereby when the unfixed sheet is not nipped in the nip portion, the pressing roller 38 is rotatively worked with the fixing belt 36 according to the movement of the fixing belt 36 due to direct frictional engagement between the fixing belt 36 and the pressing roller 36. When the unfixed sheet is nipped in the nip portion, the pressing roller 38 is also rotatively worked with the fixing belt 36 due to indirect frictional engagement between the fixing belt 36 and the pressing roller 38 through the unfixed sheet.

In this embodiment, a nip pressure P corresponding to a pressing force of the pressing roller 38 against the fixing belt 36 can be optionally arranged in any value by adjusting tension of the fixing belt 38 as well as the first embodiment.

In a condition that the endless-like fixing belt 36 is in form of cylindrical shape as shown in FIG. 3, the endless-like fixing belt 36 is formed to have inside diameter of 50 (mm). The endless-like fixing belt 36 comprises a belt base 36A having thickness of 40 ($\mu$m), which is fabricated from nickel and electroformed, and a silicon rubber layer 36B uniformly applied over a periphery of this belt base 36A with thickness of 0.5 (mm). This elastic layer 36B uses the same material as the elastic layer 18B of the pressing belt in the first embodiment. The pressing roller is formed as same manner as the fixing roller 12 in the first embodiment and the nip pressure in another embodiment is also the same as that in the first embodiment. The supporting rollers 32 and 34 is also formed as same manner as the supporting roller 14 and 16 in the first embodiment. Detail description of these common parts is abbreviated.

In the first embodiment, while it is described that the fixing roller 12 is disposed between supporting rollers 14 and 16 and also is not pressed to any of the supporting rollers, the present invention is not limited to such construction. For example, as an example modified the first embodiment shown in FIG. 5, the fixing roller 12 may be disposed to press the supporting roller 16 shown in left side of FIG. 5 through the pressing belt 18 with a particular pressure, thereby stronger pressing force can be obtained due to the fact that the elastic layer 12B of the fixing roller 12 is pressed to the supporting roller 16, thereby thickness of the elastic layer 12B of the fixing roller 12 can be formed in thinner than that of the first embodiment, thereby the effect for shorting the warm up time can be facilitated.

In the aforementioned another embodiment, while it is described that the pressing roller 38 is disposed between supporting rollers 32 and 34 and also is not pressed to any of the supporting rollers, the present invention is not limited to such construction. For example, as an example modified the first embodiment shown in FIG. 6, the pressing roller 38 may be disposed to press the supporting roller 34 shown in left side of FIG. 6 through the fixing belt 36 with a particular pressure, thereby stronger pressing force can be obtained due to the fact that the fixing belt 36 is pressed to the pressing roller 38, thereby thickness of the elastic layer 36B of the fixing belt 36 can be formed in thinner than that of another embodiment, thereby the effect for shorting the warm up time can be facilitated.

Figure 5:
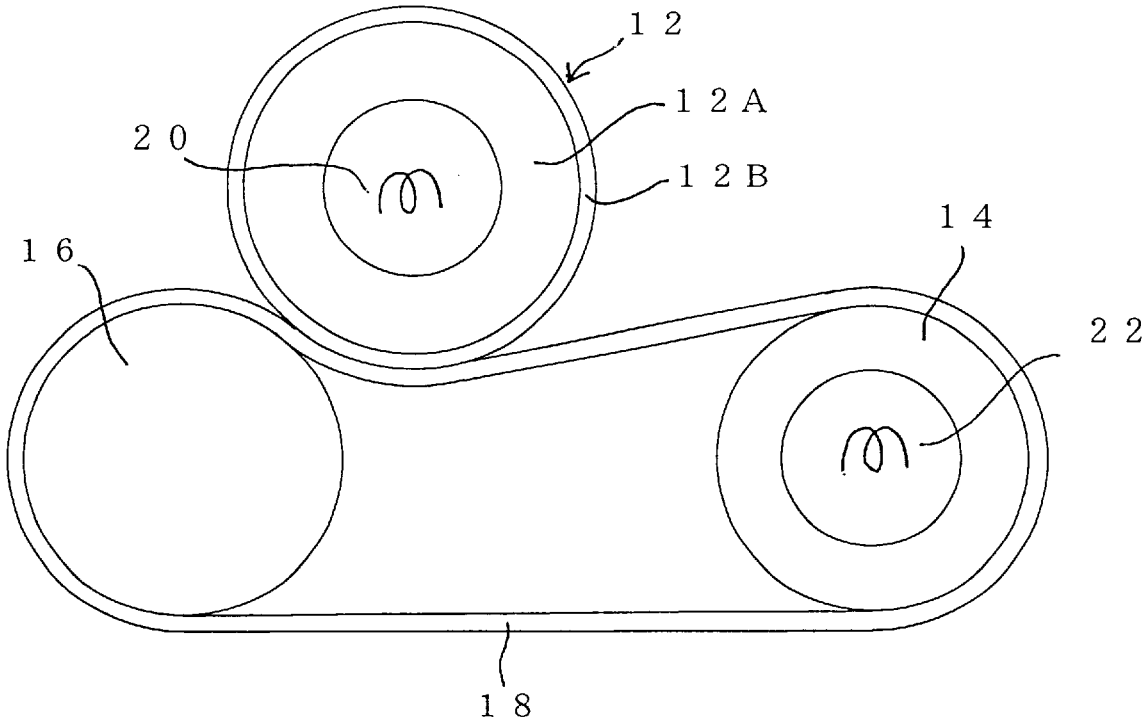
FIG. 5 is a schematic front view showing an arrangement of a modified example of the embodiment of the fixing apparatus shown in FIG. 1.
Figure 6:
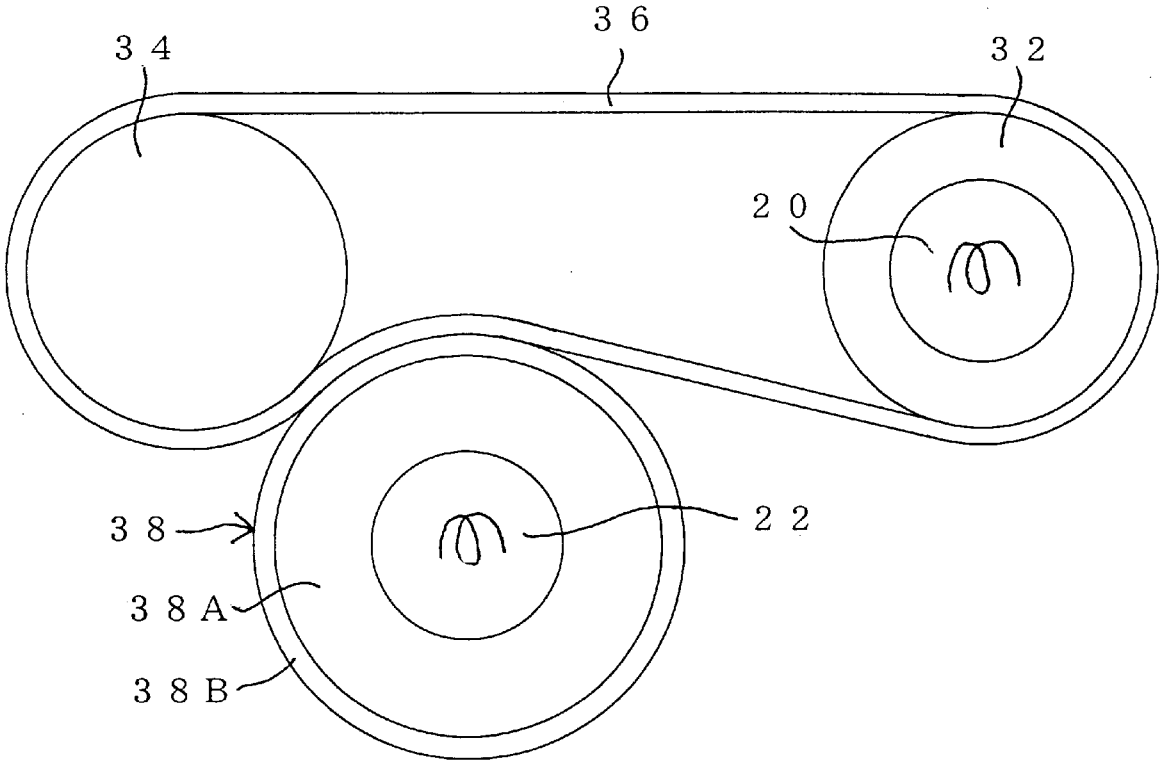
FIG. 6 is a schematic front view showing an arrangement of a modified example of the embodiment of the fixing apparatus shown in FIG. 3.

Herewith, even in the case that there exists a plurality of nip potions formed as shown in the modified examples described with reference to FIG. 5 and FIG. 6, desirable fixing operation can be implemented by satisfying the aforementioned formula (1).

As described above in detail, according to the present invention, a fixing apparatus is provided which can secure a sufficient fixing performance even if a nip pressure is arranged in relatively low value.

Further, according to the present invention, a fixing apparatus is provided which can achieve to reduce its cost by lowering a nip pressure to enable to use a low torque type driving source.

Furthermore, according to the present invention, a fixing apparatus is provided which can achieve to reduce the size and weight of a driving source and components used in the apparatus by lowering a nip pressure.

Additionally, according to the present invention, a fixing apparatus is provided which can achieve to extend an effective lifetime of the entire apparatus by lowering a nip pressure to enable to reduce torque in a driving unit of the apparatus.

TABLE 1

Table showing relationship between compressive deformation amount Δ t and fixing quality (1/3)

| Nip pressure | Young's | Thichkness (mm) $\times 10^{-3}$ mm | | | | | | | | |
|---|---|---|---|---|---|---|---|---|---|---|
| (kPa) | modulus (kPa) | 0.1 | 0.15 | 0.3 | 0.5 | 0.6 | 0.8 | 1.0 | 1.5 | 2.0 |
| 25 | 2400 | 1.0 | 1.6 | 3.1 | 5.2 | 6.3 | 8.3 | 10.4 | 15.6 | 20.8 |
| | | — | — | — | — | — | — | — | — | — |
| | 1200 | 2.1 | 3.1 | 6.3 | 10.4 | 12.5 | 16.7 | 20.8 | 31.3 | 41.7 |
| | | — | — | — | — | — | — | — | X | X |
| | 600 | 4.2 | 6.3 | 12.5 | 20.8 | 25.0 | 33.3 | 41.7 | 62.5 | 83.3 |
| | | — | — | — | — | X | X | X | ○ | ○ |
| | 300 | 8.3 | 12.5 | 25.0 | 41.7 | 50.0 | 66.7 | 83.3 | 125.0 | 166.7 |
| | | — | X | X | X | ○ | ○ | ○ | ○ | ○ |
| | 150 | 16.7 | 25.0 | 50.0 | 83.3 | 100.0 | 133.3 | 166.7 | 250.0 | 333.3 |
| | | X | X | ○ | ○ | ○ | ○ | ○ | ○ | ○ |
| 50 | 2400 | 2.1 | 3.1 | 6.3 | 10.4 | 12.5 | 16.7 | 20.8 | 31.3 | 41.7 |
| | | — | — | — | — | — | — | — | X | X |

TABLE 1-continued

Table showing relationship between compressive deformation amount Δ t and fixing quality (1/3)

| Nip pressure (kPa) | Young's modulus (kPa) | Thichkness (mm) ×10⁻³ mm 0.1 | 0.15 | 0.3 | 0.5 | 0.6 | 0.8 | 1.0 | 1.5 | 2.0 |
|---|---|---|---|---|---|---|---|---|---|---|
| | 1200 | 4.2 | 6.3 | 12.5 | 20.8 | 25.0 | 33.3 | 41.7 | 62.5 | 83.3 |
| | | — | — | — | — | X | X | X | ○ | ○ |
| | 600 | 8.3 | 12.5 | 25.0 | 41.7 | 50.0 | 66.7 | 83.3 | 125.0 | 166.7 |
| | | — | — | X | X | ○ | ○ | ○ | ○ | ○ |
| | 300 | 16.7 | 25.0 | 50.0 | 83.3 | 100.0 | 133.3 | 166.7 | 250.0 | 333.3 |
| | | — | X | ○ | ○ | ○ | ○ | ○ | ○ | ○ |
| | 150 | 33.3 | 50.0 | 100.0 | 166.7 | 200.0 | 266.7 | 333.3 | 500.0 | 666.7 |
| | | X | ○ | ○ | ○ | ○ | ○ | ○ | ○ | X |

TABLE 2

Table showing relationship between compressive deformation amount Δ t and fixing quality (2/3)

| Nip pressure (kPa) | Young's modulus (kPa) | Thichkness (mm) ×10⁻³ mm 0.1 | 0.15 | 0.3 | 0.5 | 0.6 | 0.8 | 1.0 | 1.5 | 2.0 |
|---|---|---|---|---|---|---|---|---|---|---|
| 75 | 2400 | 3.1 | 4.7 | 9.4 | 15.6 | 18.8 | 25.0 | 31.3 | 46.9 | 62.5 |
| | | — | — | — | — | — | X | X | X | ○ |
| | 1200 | 6.3 | 9.4 | 18.8 | 31.3 | 37.5 | 50.0 | 62.5 | 93.8 | 125.0 |
| | | — | — | — | X | X | ○ | ○ | ○ | ○ |
| | 600 | 12.5 | 18.8 | 37.5 | 62.5 | 75.0 | 100.0 | 125.0 | 187.5 | 250.0 |
| | | — | — | X | ○ | ○ | ○ | ○ | ○ | |
| | 300 | 25.0 | 37.5 | 75.0 | 125.0 | 150.0 | 200.0 | 250.0 | 375.0 | 500.0 |
| | | X | X | ○ | ○ | ○ | ○ | ○ | ○ | |
| | 150 | 50.0 | 75.0 | 150.0 | 250.0 | 300.0 | 400.0 | 500.0 | 750.0 | 1000.0 |
| | | X | X | X | X | X | X | X | X | X |
| 100 | 2400 | 4.2 | 6.3 | 12.5 | 20.8 | 25.0 | 33.3 | 41.7 | 62.5 | 83.3 |
| | | | — | — | — | X | X | X | ○ | ○ |
| | 1200 | 8.3 | 12.5 | 25.0 | 41.7 | 50.0 | 66.7 | 83.3 | 125.0 | 166.6 |
| | | | — | X | X | ○ | ○ | ○ | ○ | ○ |
| | 600 | 16.7 | 25.0 | 50.0 | 83.3 | 100.0 | 133.3 | 166.7 | 250.0 | 333.3 |
| | | | X | ○ | ○ | ○ | ○ | ○ | ○ | |
| | 300 | 33.3 | 50.0 | 100.0 | 166.7 | 200.0 | 266.6 | 333.3 | 500.0 | 666.7 |
| | | X | ○ | ○ | ○ | ○ | ○ | ○ | ○ | X |
| | 150 | 66.7 | 100.0 | 200.0 | 333.3 | 400.0 | 533.3 | 666.7 | 1000.0 | 1333.3 |
| | | | X | X | X | X | X | X | X | X |

TABLE 3

Table showing relationship between compressive deformation amount Δ t and fixing quality (3/3)

| Nip pressure (kPa) | Young's modulus (kPa) | Thichkness (mm) ×10⁻³ mm 0.1 | 0.15 | 0.3 | 0.5 | 0.6 | 0.8 | 1.0 | 1.5 | 2.0 |
|---|---|---|---|---|---|---|---|---|---|---|
| 150 | 2400 | 6.3 | 9.4 | 18.8 | 31.3 | 37.5 | 50.0 | 62.5 | 93.8 | 125.0 |
| | | — | — | — | — | — | X | X | X | ○ |
| | 1200 | 12.5 | 18.8 | 37.5 | 62.5 | 75.0 | 100.0 | 125.0 | 250.0 | 250.0 |
| | | — | — | — | X | X | ○ | ○ | ○ | ○ |
| | 600 | 25.0 | 37.5 | 75.0 | 125.0 | 150.0 | 200.0 | 250.0 | 375.0 | 500.0 |
| | | — | — | X | ○ | ○ | ○ | ○ | ○ | ○ |
| | 300 | 50.0 | 75.0 | 150.0 | 250.0 | 300.0 | 400.0 | 500.0 | 750.0 | 1000.0 |
| | | X | X | ○ | ○ | ○ | ○ | ○ | ○ | ○ |
| 200 | 150 | 100.0 | 150.0 | 300.0 | 500.0 | 600.0 | 800.0 | 1000.0 | 1500.0 | 2000.0 |
| | | X | X | X | X | X | X | X | X | X |
| | 2400 | 8.3 | 12.5 | 25.5 | 41.7 | 50.0 | 66.7 | 83.3 | 125.0 | 166.6 |

TABLE 3-continued

Table showing relationship between compressive deformation amount Δ t and fixing quality (3/3)

| Nip pressure (kPa) | Young's modulus (kPa) | Thichkness (mm) $\times 10^{-3}$ mm | | | | | | | | |
|---|---|---|---|---|---|---|---|---|---|---|
| | | 0.1 | 0.15 | 0.3 | 0.5 | 0.6 | 0.8 | 1.0 | 1.5 | 2.0 |
| | | — | — | X | X | ○ | ○ | ○ | ○ | ○ |
| | 1200 | 16.7 | 25.0 | 50.0 | 83.3 | 100.0 | 133.3 | 166.7 | 250.0 | 333.3 |
| | | X | X | ○ | ○ | ○ | ○ | ○ | ○ | ○ |
| | 600 | 33.3 | 50.0 | 100.0 | 166.7 | 200.0 | 266.7 | 333.3 | 500.0 | 666.7 |
| | | X | ○ | ○ | ○ | ○ | ○ | ○ | ○ | X |
| | 300 | 66.7 | 100.0 | 200.0 | 333.3 | 400.0 | 533.3 | 666.7 | 1000.0 | 1333.3 |
| | | X | X | X | X | X | X | X | X | X |
| | 150 | 133.3 | 200.0 | 400.0 | 666.7 | 800.0 | 1066.7 | 1333.3 | 2000.0 | 2666.6 |
| | | X | X | X | X | X | X | X | X | X |

What is claimed is:

1. A fixing apparatus comprising:

a fixing member having an elastic layer formed on said fixing member at a side to which a sheet surface supporting an unfixed toner is contacted;

a pressing member for making said sheet surface supporting the unfixed toner contact to said fixing member with a particular pressure and forming a nip portion between said fixing member and said pressing member; and a heating means heating said fixing member, wherein $0.05 \leqq P \cdot t/E \leqq 0.50$ is satisfied, where t (mm) is thickness of said elastic layer, E (Pa) is Young's modulus of said elastic layer and P (Pa) is pressure in said nip portion.

2. A fixing apparatus as defined in claim 1, wherein said Young's modulus E (Pa) of said elastic layer and said pressure P (Pa) of said nip portion satisfy $P/E \leqq 0.50$.

3. A fixing apparatus as defined in claim 2, wherein said fixing member includes an endless-like fixing belt having said elastic layer on a periphery of said fixing belt, to which said sheet surface supporting the unfixed toner is contacted, and said pressing means includes a pressing roller contacted to said elastic layer of said fixing belt with a particular nip width.

4. A fixing apparatus as defined in claim 3, wherein said fixing belt is wound around plural supporting rollers spaced apart each other in endless manner with positioning said pressing roller between each of said plural supporting rollers, and said heating means includes a heat-generating source for heating said fixing belt.

5. A fixing apparatus as defined in claim 4, wherein said heating means further includes a second heat-generating source for heating said pressing roller.

6. A fixing apparatus as defined in claim 2, wherein said fixing member includes a releasing layer on a periphery of said elastic layer.

7. A fixing apparatus as defined in claim 2, wherein thickness t of said elastic layer is arranged in the range from 0.15 (mm) to 2.0 (mm).

8. A fixing apparatus as defined in claim 2, wherein said Young's modulus E is arranged in the range from 150 (k Pa) 2400 (k Pa).

9. A fixing apparatus as defined in claim 2, wherein said pressure P is arranged in the range from 25 (k Pa) to 200 (k Pa).

10. A fixing apparatus as defined in claim 1 or 2, wherein said fixing member includes a fixing roller having said elastic layer on a periphery of said fixing roller, to which said sheet surface supporting the unfixed toner is contacted, and said pressing means includes an endless-like pressing belt contacted to said elastic layer of said fixing roller with a particular nip width.

11. A fixing apparatus as defined in claim 10, wherein said heating means includes a heat-generating source for heating said fixing roller.

12. A fixing apparatus as defined in claim 11, wherein said pressing belt is wound around plural supporting rollers spaced apart each other in endless manner with positioning said fixing roller between each of said plural supporting rollers, and said heating means further includes a second heat-generating source for heating said pressing belt.

13. A fixing apparatus as defined in claim 1, wherein said fixing member includes an endless-like fixing belt having said elastic layer on a periphery of said fixing belt, to which said sheet surface supporting the unfixed toner is contacted, and said pressing means includes a pressing roller contacted to said elastic layer of said fixing belt with a particular nip width.

14. A fixing apparatus as defined in claim 13, wherein said fixing belt is wound around plural supporting rollers spaced apart each other in endless manner with positioning said pressing roller between each of said plural supporting rollers, and said heating means includes a heat-generating source for heating said fixing belt.

15. A fixing apparatus as defined in claim 14, wherein said heating means further includes a second heat-generating source for heating said pressing roller.

16. A fixing apparatus as defined in claim 1, wherein said fixing member includes a releasing layer on a periphery of said elastic layer.

17. A fixing apparatus as defined in claim 1, wherein thickness t of said elastic layer is arranged in the range from 0.15 (mm) to 2.0 (mm).

18. A fixing apparatus as defined in claim 1, wherein said Young's modulus E is arranged in the range from 150 (k Pa) to 2400 (k Pa).

19. A fixing apparatus as defined in claim 1, wherein said nip pressure P is arranged in the range from 25 (k Pa) to 200 (k Pa).

* * * * *